United States Patent [19]

Hague

[11] Patent Number: 4,466,224

[45] Date of Patent: Aug. 21, 1984

[54] TWO-PIECE ATTACHMENT CLIP FOR INSULATED ROOF OR WALL STRUCTURE

[75] Inventor: James G. Hague, Mars, Pa.

[73] Assignee: H. H. Robertson Company, Pittsburgh, Pa.

[21] Appl. No.: 389,845

[22] Filed: Jun. 18, 1982

[51] Int. Cl.[3] ..... E04D 3/362; E04D 3/38

[52] U.S. Cl. ..... 52/478; 52/407; 52/520; 52/529; 52/544; 52/713

[58] Field of Search ..... 52/520, 543, 546, 536, 52/394, 395, 410, 714, 478, 407, 530, 529, 544, 713

[56] References Cited

U.S. PATENT DOCUMENTS

| | | | |
|---|---|---|---|
| 3,387,872 | 6/1968 | Lovullo et al. | 52/714 |
| 3,998,019 | 12/1976 | Reinwall, Jr. | 52/520 |
| 4,099,356 | 7/1978 | Graham | 52/520 |
| 4,102,105 | 7/1978 | Taylor et al. | 52/520 |
| 4,139,974 | 2/1979 | Fox | 52/404 |
| 4,213,282 | 7/1980 | Heckelsberg | 52/404 |
| 4,400,922 | 8/1983 | Boyer | 52/394 |

OTHER PUBLICATIONS (Author Unknown), "Manufacturers Embrace Standing Seam Roof Systems," *Metal Building Review,* (May, 1980), 86–98.

*Primary Examiner*—Alfred C. Perham
*Attorney, Agent, or Firm*—G. E. Manias

[57] ABSTRACT

A two-piece concealed-type clip assembly useful in attaching profiled panel members to structural elements to provide an insulated roof or wall structure incorporating blanket or roll-type insulation. The clip assembly includes a U-shaped base clip having a relatively narrow bottom wall, upstanding sidewalls, and integral clip-stabilizing portions, one extending laterally outwardly from each sidewall; and flexible connecting means such as a top clip, carried at the upper ends of the sidewalls for connecting a rib of a panel member to a structural element. Only a minor amount of insulation is fully compressed at each clip assembly site whereby the structure exhibits an improved thermal efficiency.

10 Claims, 7 Drawing Figures

TWO-PIECE ATTACHMENT CLIP FOR INSULATED ROOF OR WALL STRUCTURE

BACKGROUND OF THE INVENTION

1. Field of the Invention

This invention relates to single-skin insulated roof or wall structures, and more particularly to improvements in a two-piece concealed-type attachment clip for securing panels to the structural elements of a building framework.

2. Description of the Prior Art

Single-skin roof or wall structures are known wherein lengths of blanket-type or roll-type insulation, arranged in side-by-side relation, span across plural structural elements. Concealed attachment clips overlying and fully compressing the insulation therebeneath, are secured to the subjacent structural elements. Panel members assembled in side-by-side interlocked relation, are secured to the structural elements by the concealed attachment clips. The full compression of the insulation at each clip site reduces the thermal efficiency of the structure. See for example U.S. Pat. No. 4,139,974 (FOX).

Substantially incompressible thermal spacers have been provided along the structural elements between adjacent clips. The thermal spacer provides support for the subsequently installed panels and adds to the thermal efficiency of the structure. See for example U.S. Pat. No. 4,213,282 (HECKELSBERG) and the RI-BLOCK system illustrated and described on Page 92 of "Metal Building Review", Volume 16, No. 5, May, 1980. The thermal spacers constitute additional elements to be installed thereby increasing the materials cost, the erection time, and consequently the overall cost of the roof or wall structure.

SUMMARY OF THE INVENTION

The principal object of this invention is to provide a two-piece clip assembly for use in and for improving the thermal efficiency of an insulated wall or roof structure.

Another object of this invention is to provide an improved two-piece clip assembly which eliminates the need for expensive subgirt and stand-off support systems.

The present invention provides improvements in an insulated roof or wall structure of the type having horizontally extending, spaced-apart structural elements; compressible insulation spanning transversely across the structural elements; plural panel members overlying the insulation, spanning transversely across the structural elements, and being erected in side-by-side relation, the panel members presenting alternating panel webs and upstanding, downwardly opening longitudinal ribs each presenting an entrance opening and spaced-apart latching shoulders on opposite sides of the opening; and two-piece clip assembly securing the ribs to the structural elements. Each of the clip assemblies includes a U-base clip having a bottom wall and upstanding sidewalls, and flexible connecting means carried at the upper ends of the sidewalls and interengaged with the latching shoulders of an associated rib, thereby connecting the rib to the structural element. The bottom wall of the clip is secured to the subjacent structural element and fully compresses the underlying insulation.

In accordance with this invention, integral clip-stabilizing portions are provided, one extending laterally outwardly from each of the sidewalls. Each of the clip-stabilizing portions includes a horizontal upper segment supporting the overlying panel and, connected thereto, a horizontal lower segment which is vertically spaced from the structural element and from the upper segment. The lower segments are spaced-apart from the adjacent sidewalls and partially compress the underlying insulation. The lower segments—being widely spaced-apart—introduce lateral stability into the U-shaped base clip. Therefore the bottom wall may be relatively narrow (less than $\frac{7}{8}''$) and, as a result, the thermal degradation due to full compression of the insulation is significantly reduced.

DESCRIPTION OF THE PREFERRED EMBODIMENT(S)

Figure 1:
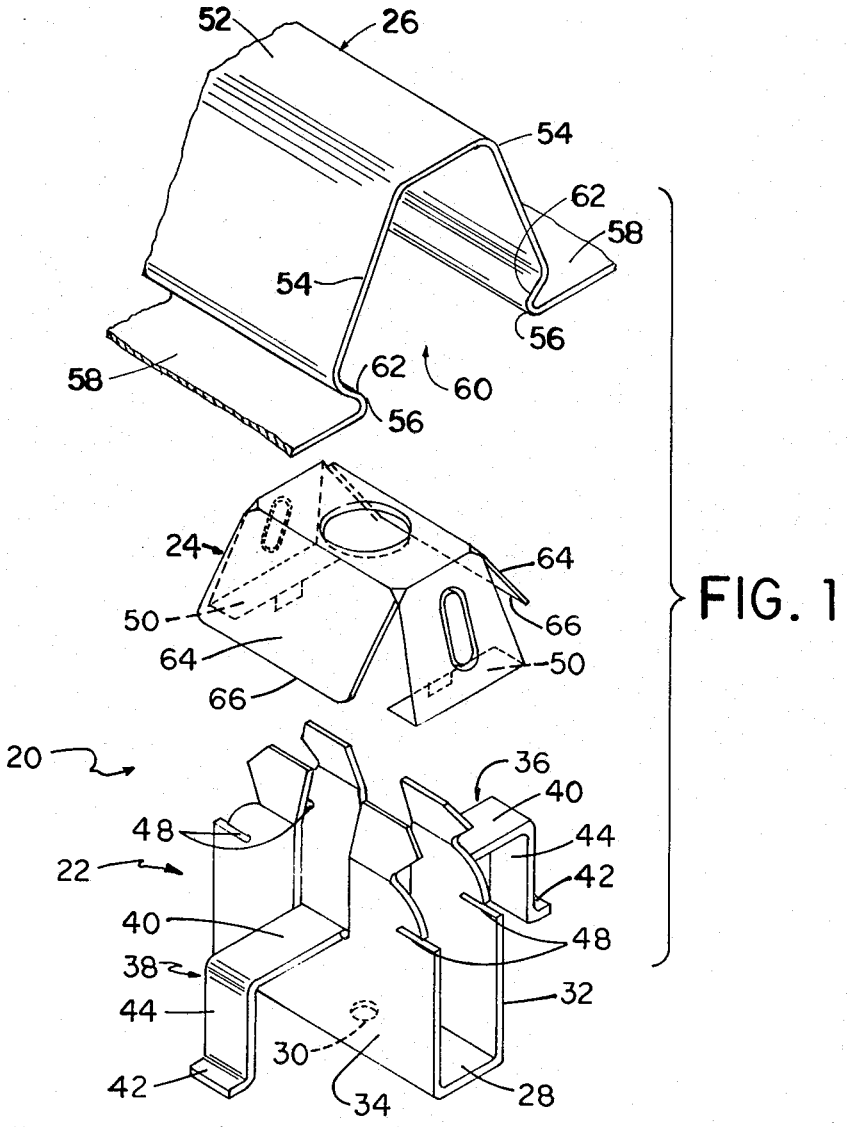
FIG. 1 is an exploded isometric view illustrating the present two-piece clip assembly and a portion of a panel rib.

FIG. 1 illustrates a two-piece clip assembly 20 comprising a U-shaped base clip 22 and flexible connecting means, such as, a top clip 24, positioned in relation to an intermediate panel rib 26.

Referring to FIGS. 1–4, the U-shaped base clip 22 comprises a bottom wall 28 provided with a central screw-receiving aperture 30; upstanding sidewalls 32, 34; and integral clip-stabilizing portions 36, 38, one extending laterally outwardly from each of the sidewalls 32, 34. Each of the clip-stabilizing portions 36, 38 includes a horizontal upper segment 40, a horizontal lower segment 42 and an intermediate segment 44 connecting the upper segment 40 to the lower segment 42. The base clip 22 may be formed from 18 gauge (1.311 mm) galvanized steel. The base clip 22 preferably is formed from a single sheet wherein the clip-stabilizing portions are pierced from the sidewalls 32, 34.

The base clip 22 is similar to that disclosed and claimed in U.S. copending application Ser. No. 249,062 (BOYER) filed Mar. 30, 1981 and assigned to the assignee of this invention and now U.S. Pat. No. 4,400,922. The base clip 22 differs from that of copending application Ser. No. 249,062 (now U.S. Pat. No. 4,400,922) in two respects. That is, the clip 22 has a greater height, and the clip-stabilizing portions 36, 38 have been added.

Figure 3:
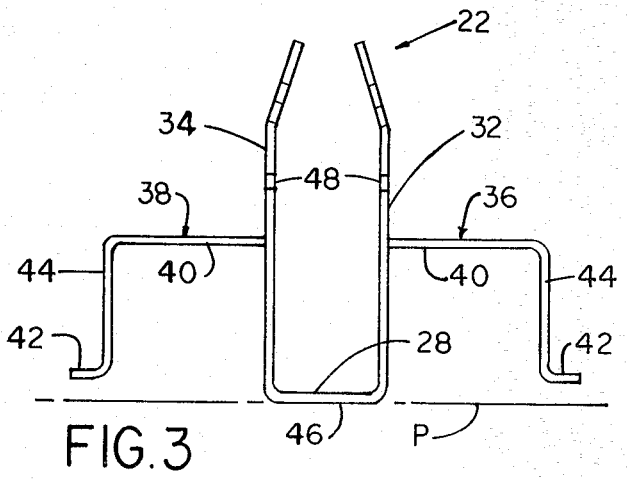
FIG. 3 is an end view of the U-shaped base clip.
Figure 4:
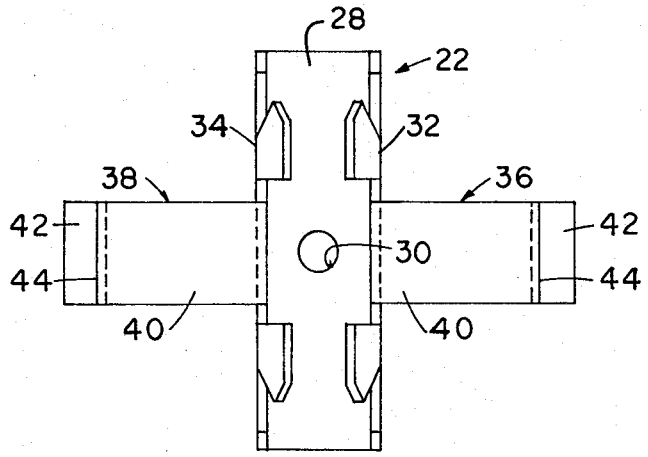
FIG. 4 is a top view of the U-shaped base clip.

As can best be seen in FIG. 3, each of the lower segments 42 is outwardly spaced-apart from the adjacent sidewalls 32, 34 and extends outwardly beyond the associated upper segment 40. The widely spaced-apart positions of the lower segments 42 enhances the lateral stability of the clip 22, that is, enhances the resistance to rocking of the clip 22 in the plane of the drawing. As a result, the bottom wall 28 may be relatively narrow. For example, in one commercial embodiment, the width of the bottom wall 28 is less than $\frac{7}{8}''$. As can best be seen in FIG. 3, the lower segments 42 are adjacent to but vertically spaced-apart from a plane (dash-dot line P) of the lower face 46 of the bottom wall 28. The lower segments 42 preferably lie in a common plane (not illustrated) generally parallel with the plane P. As will be more fully described, insulation is partially compressed between each of the lower segments 42 and a structural element whose upper face corresponds to the plane P. While the insulation is not fully compressed at these locations, it is compressed enough to resist lateral forces and to transfer the same from the lower segments 42 through the clip 22 to the structural element.

Figure 2:
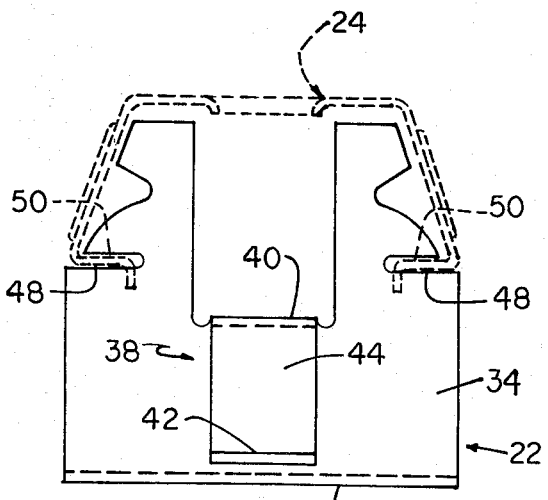
FIG. 2 is a side view of a U-shaped base clip.

Returning to FIGS. 1 and 2, the upper ends of the sidewalls 32, 34 are provided with oppositely extending slots 48 which receive inturned flanges 50 presented by the top clip 24. In FIG. 2, the top clip 24 shown in phantom outline with the inturned flanges 50 thereof engaged in the slots 48. As will be described, the top clip 24 is supported by the flange-to-slot connections for limited movement transversely of the sidewalls 32, 34.

The panel rib 26 (FIG. 1) includes a crest 52, depending rib sidewalls 54 and reverse-turned base portions 56 connecting the rib sidewalls 54 to adjacent panel webs 58. The base portions 56 define an entrance opening 60 and present latching shoulders 62.

The top clip 24 presents a downwardly depending clamping wings 64 which terminate in clamping edges 66 extending generally parallel with the length of the rib 26 and are positioned to engage the latching shoulders 62 thereby connecting the rib 26 to the base clip 22. As the top clip 24 is introduced through the entrance opening 60, the clamping wings 64 are flexed toward each other and thereafter move away from each other such that the clamping edges 66 are resiliently engaged with the latching shoulders 62. Consequently, the top clip 24 preferably is formed from spring steel having a thickness of from 18 gauge (1.214 mm) to about 22 gauge (0.760 mm).

Figure 5:
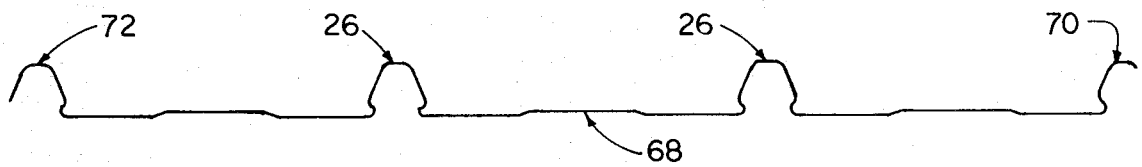
FIG. 5 is an end view of a panel member.

Turning now to FIG. 5, there is illustrated a panel member 68 presenting two intermediate ribs 26, and male and female partial ribs 70, 72 along the opposite edges thereof. Each of the partial ribs 70, 72 is overlappable and interfittable with a complementary partial rib 72, 70 of an adjacent panel member to provide a joint rib such as identified at 74 in FIGS. 6, 7 having a cross-sectional configuration duplicating that of the intermediate ribs 26.

Figure 6:
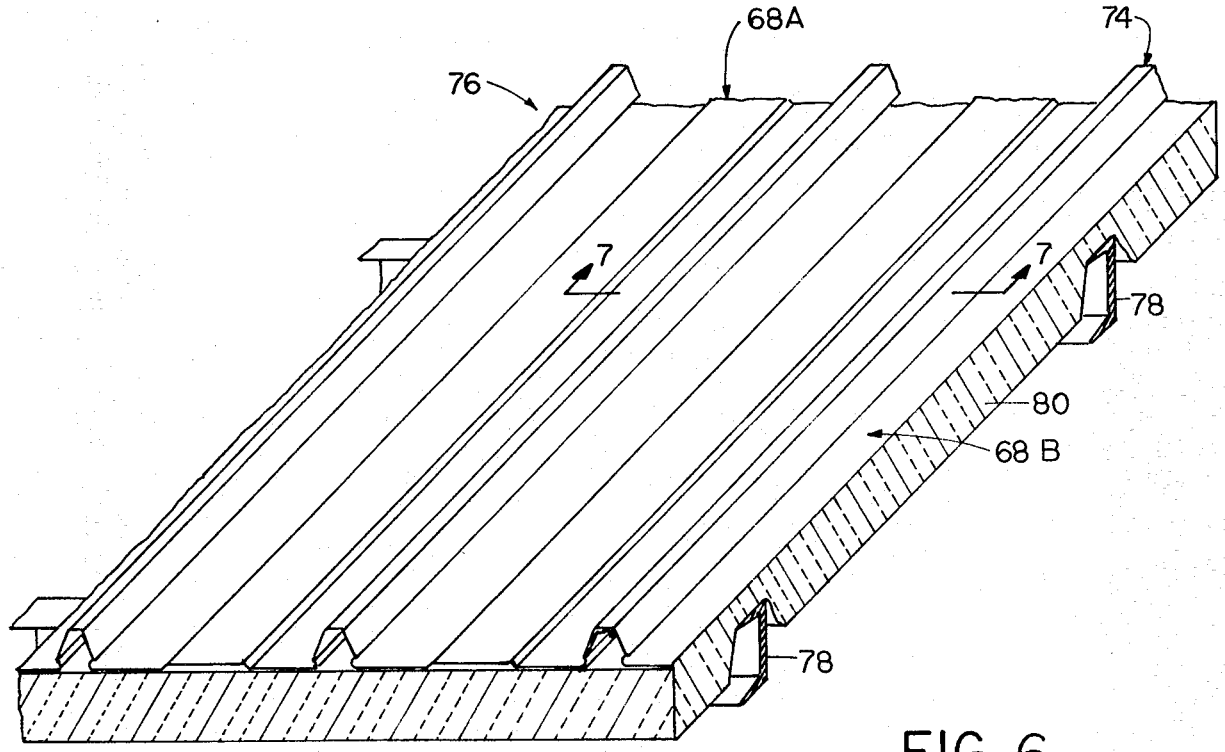
FIG. 6 is a fragmentary isometric view of a roof or wall structure.

FIG. 6 illustrates a roof or wall structure 76 having horizontally extending, spaced-apart structural elements 78 provided by the structural framework of a building. Blanket-type or roll-type compressible insulation 80 spans transversely across and between the structural elements 78. Plural panel members 68A, 68B overlie the insulation, span transversely across the structural elements 78 and are erected in side-by-side relation and are interlocked at the joint rib 74.

Figure 7:
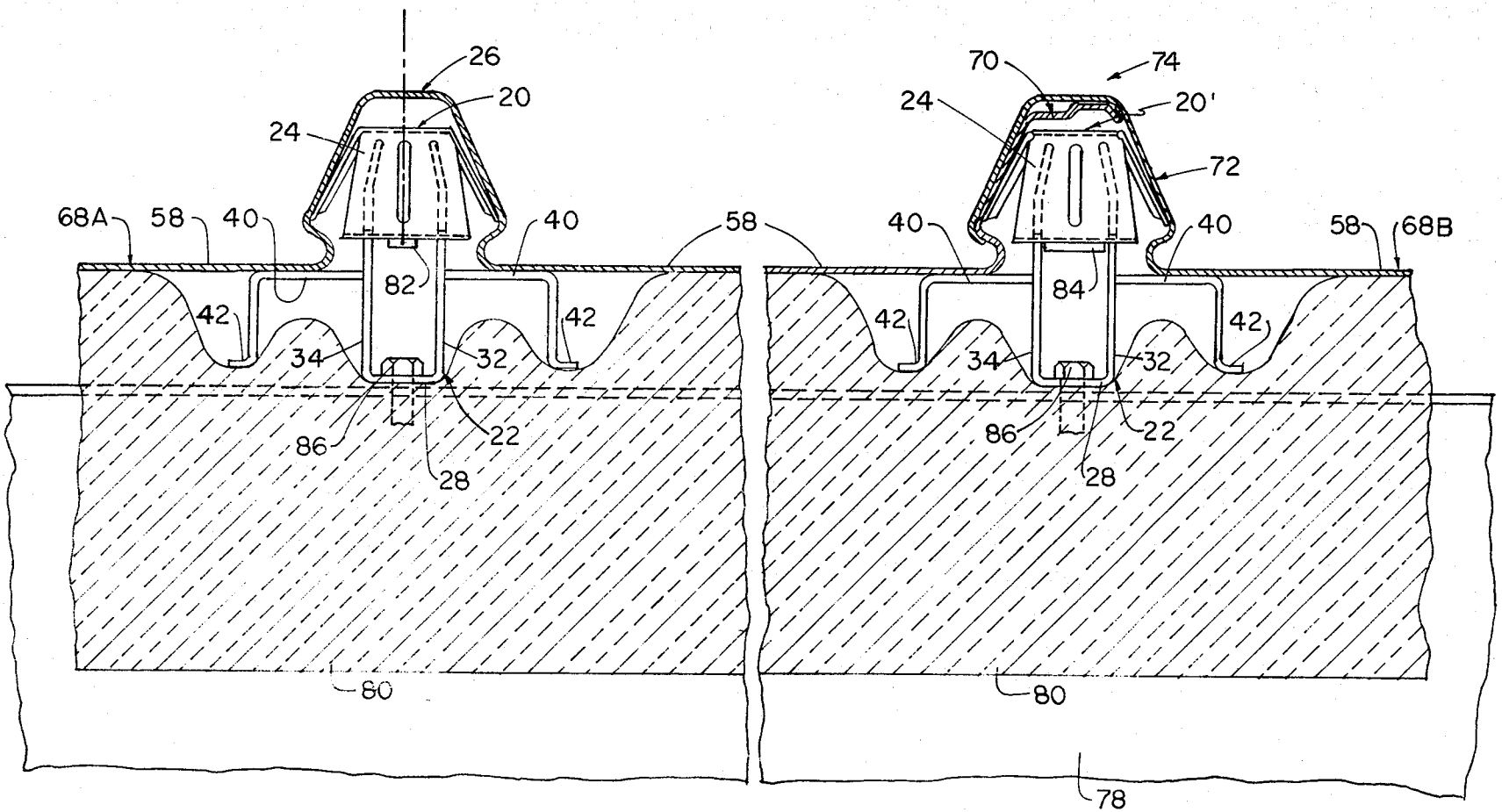
FIG. 7 is a cross-sectional view taken along the line 7—7 of FIG. 6.

Referring to FIG. 7, it should be noted that the intermediate rib 26 is connected to the structural elements 78 by the clip assembly 20 wherein the top clip 24 thereof may undergo limited transverse movement relative to the base clip 22. The transverse movement of the top clip 24 is limited by engagement of relatively narrow tabs 82 (only one visible) with the sidewalls of the base clip 22. The joint rib 74 is connected to the structural element 78 by a clip assembly 20' wherein the top clip 24 thereof is substantially immovable relative to the base clip 22. The top clip 24 is fixed relative to the base clip 22 by relatively wide tabs 84 (only one visible in FIG. 7) having a width substantially equal to the distance between the upstanding sidewalls 32, 34. The use of the fixed and movable top clips 24 allows the manufactured width of the panel members 68A, 68B to be conformed to the desired panel coverage. For a more detailed description of the fixed and movable top clip arrangement and its use, attention is directed to my copending application Ser. No. 06/376,169 filed May 7, 1982 and assigned to the assignee of the present invention—the disclosure of the aforesaid copending application Ser. No. 06/376,169 being incorporated herein by reference.

Each of the base clips 22 is secured to the structural element 78 by a positive fastener 86. Thus arranged, the horizontal upper segments 40 support the panel webs 58 on opposite sides of each intermediate rib 26 and of the joint rib 74. It will be observed that once each base clip 22 is installed, only that portion of the insulation 80 directly beneath the relatively narrow bottom wall 28 is fully compressed, whereas those portions of the insulation 80 directly beneath the lower horizontal segments 42 are partially compressed. Thus in the regions beneath the lower segments 42, the insulation is not totally compressed but is compressed enough to resist lateral forces applied to the clip assembly 20 and to transfer the same to the structural element 78. The arrangement is such that the clip assembly resists lateral forces induced during installation of the panel members; and to resist lateral roof loads such as exist due to dead and live loads. Because of the relatively widely spaced-apart positions of the lower segments 42 and the resistance to lateral loads offered thereby, the bottom wall 28 of the clip 22 is not a wide element but, instead, is a relatively narrow element. In a commercial embodiment, the width of the bottom wall 28 is less than $\frac{7}{8}''$. It will also be observed in FIG. 4 that the area of the lower face of each of the lower segments 42 is substantially less than that of the bottom wall 28. That is, the width and the length of each bottom segment 42 are substantially less than the corresponding dimensions of the bottom wall 28. Consequently, the areas of the insulation 80 which are partially compressed by the lower segments 42 are minimized as in the thermal degradation attributable to compression of the insulation 80.

It will be observed that in the regions beyond the horizontal lower segments 42 of each clip 22, the insulation 80 is partially compressed but fills the spaces between the panel webs 58 and the structural element 78. Thus in the region between adjacent clip assemblies, the panel webs 58 are resiliently urged outwardly by the partially compressed insulation thereby inhibiting vibration of the panel webs due to varying wind velocities.

I claim:

1. An insulated roof or wall structure having horizontally extending, spaced-apart structural elements; compressible insulation spanning transversely across said structural elements; plural panel members overlying said insulation, spanning transversely across said structural elements, and being erected in side-by-side relation, said panel members presenting alternating panel webs and upstanding, downwardly opening longitudinal ribs each presenting an entrance opening and spaced-apart latching shoulders on opposite sides of said opening; and two-piece clip assemblies securing said ribs to said structural elements; each of said clip assemblies including:

a U-shaped base clip including a bottom wall secured to the subjacent structural element and fully compressing the underlying insulation, upstanding sidewalls extending into an associated rib, and integral clip-stabilizing portions, one extending laterally outwardly from each of said sidewalls, each of said clip-stabilizing portions including a horizontal upper segment supporting an overlying panel web and a horizontal lower segment vertically spaced from the structural element and from said upper segment and partially compressing the underlying insulation; and flexible connecting means carried at upper ends of said sidewalls and interengaged with the latching shoulders of an associated rib connecting the associated rib to the structural element.

2. The insulated roof or wall structure defined in claim 1 wherein each said lower segment extends outwardly beyond said upper segment.

3. The insulated roof or wall structure defined in claim 1 wherein said bottom wall has a width of less than $\frac{7}{8}''$, thereby to minimize the area of said insulation which is fully compressed.

4. The insulated roof or wall structure as defined in claim 1, 2 or 3 wherein the area of the lower face of each said lower segment is substantially less than that of said bottom wall, thereby to minimize the areas of said insulation which are partially compressed.

5. A two-piece clip assembly comprising:

a U-shaped base clip including a bottom wall, upstanding sidewalls presenting upper ends and clip-stabilizing portions, one extending laterally outwardly from each of said sidewalls of a level below said upper ends, each of said clip-stabilizing portions including a horizontal upper segment, a horizontal lower segment above the level of said bottom wall, and an intermediate segment connecting said upper segment to said lower segment; and flexible connecting means detachably connected to said upper ends of said sidewalls for connecting a panel member to a structural element.

6. The clip assembly as defined in claim 5 wherein each said lower segment extends outwardly beyond the associated upper segment.

7. The clip assembly as defined in claim 5 or 6 wherein said clip-stabilizing portions comprise segments of said sidewalls.

8. The clip assembly as defined in claim 5 or 6 wherein the lower segments of said clip-stabilizing portions lie in a common plane generally parallel with a lower face of said bottom wall.

9. The clip assembly as defined in claim 5 or 6 wherein said bottom wall has a width of less than $\frac{7}{8}''$.

10. The clip assembly as defined in claim 9 wherein the area of the lower face of each said lower segment is substantially less than that of said bottom wall.

* * * * *